United States Patent [19]

Nosler

[11] 4,384,195

[45] May 17, 1983

[54] EDGE-RESPONSIVE APPARATUS FOR COUNTING CONVEYOR-TRANSPORTED ARTICLES

[75] Inventor: John C. Nosler, Eugene, Oreg.

[73] Assignee: The Coe Manufacturing Company, Tigard, Oreg.

[21] Appl. No.: 157,657

[22] Filed: Jun. 9, 1980

[51] Int. Cl.[3] ..... G06M 7/06

[52] U.S. Cl. ..... 377/53; 377/6; 377/8

[58] Field of Search ..... 235/92 V, 92 SB, 92 PK, 235/98 C; 250/223 R, 222 PC; 356/448

[56] References Cited

U.S. PATENT DOCUMENTS

| | | | |
|---|---|---|---|
| 3,737,666 | 6/1973 | Dutro | 250/223 R |
| 3,835,306 | 9/1974 | Bills et al. | 235/92 SB |
| 3,919,531 | 11/1975 | Bobel et al. | 235/92 V X |
| 4,139,765 | 2/1979 | Pomey | 235/92 SB |
| 4,217,491 | 8/1980 | Dufford, Jr. et al. | 250/223 R |
| 4,296,314 | 10/1981 | Dabisch et al. | 235/92 SB |

*Primary Examiner*—David H. Malzahn

*Attorney, Agent, or Firm*—Kolisch, Hartwell & Dickinson

[57] ABSTRACT

Apparatus for counting conveyor-transported articles, such as newspapers. The apparatus employes a laser which projects a beam to create reflections from such articles, which reflections are imaged onto a linear photodetector array. The array is scanned recurrently to detect the presence and location of such an image, and related, successive output signals from the array are fed to a data-processing circuit which confirms the occurrence of each passing article. Such confirmation is based on the pre-known manner in which the successive leading-edge profiles of passing articles cause multiple output signals of a certain character to be produced by the array.

4 Claims, 4 Drawing Figures

EDGE-RESPONSIVE APPARATUS FOR COUNTING CONVEYOR-TRANSPORTED ARTICLES

BACKGROUND AND SUMMARY OF THE INVENTION

This invention pertains to apparatus for counting articles carried on a conveyor, or the like, and in particular, relates to such apparatus wherein counting accuracy is achieved through discriminating on the basis of the leading-edge profiles of successive traveling articles.

While it will be obvious to those skilled in the art that the instant invention has utility in a relatively wide range of applications, a preferred embodiment thereof is described herein in conjunction with the counting of newspapers—an application with respect to which it has been found to have particular utility.

Modern newspapers are printed, cut, assembled and folded at very high speeds. Completed newspapers are typically fed to an offbearing conveyor, with successive newspapers over-lapping one another with their leading, folded edges spaced several inches apart. A typical offbearing conveyor speed is about 4.5-feet-per-second.

The offbearing conveyor usually feeds what is known as a counter/stacker, wherein the oncoming newspapers are stacked, counted mechanically as they are stacked, and delivered in bundles of possibly differing predetermined numbers of papers, according to final destination. Conventional mechanical counting, however, in such a situation is often inaccurate. This is wasteful, and over time can seriously affect profitability.

A general object of the present invention is to provide a unique electro-optical non-contacting solution to the problem of counting conveyor-transported articles, such as newspapers.

More particularly, an object of the invention is to provide such apparatus for counting articles which offers an extremely high degree of accuracy and reliability.

Featured in the proposed apparatus is a laser which projects a beam to create reflections from the articles which are to be counted (in the case to be described below, newspapers), which reflections are imaged onto a linear photodetector array. The array is scanned recurrently to detect the presence and location of such an image, with the knowledge, from the geometry of the apparatus, that the position of such an image is directly related to the distance from the laser to the point of impingement with the reflecting article. Circuitry associated with the array produces, from such images, related output signals which are fed to a data-processing circuit. The latter circuit examines the train of incoming array signals to confirm the occurrence of a passing article. Such confirmation is based on the pre-known manner in which the successive leading-edge profiles of articles cause successive output signals from the array to be of a certain recognizable character. In the case of counting newspapers, naturally, it is the leading edge folded profile of the papers which generates a pattern of output signals in what was just referred to as a "pre-known manner".

As will be more fully explained below, with a stream of newspapers of the same folded size, and assuming for a moment that successive papers are arranged on a conveyor with a uniform condition of overlap, the highest points of the leading edges of the papers will lie at a certain distance above the transport plane of the conveyor. From pre-existing acquired data respecting passing, counted newspapers, or from assumed data supplied at the beginning of a run, as will be described, a reference threshold is established, regarding which the successive leading edges of adjacent papers will be characterized by a surface expanse which extends upwardly relative to the conveyor plane, immediately followed, for each given paper, by another surface expanse which generally parallels the conveyor plane for a short distance.

Signals which are generated by the array, as a result of laser-beam reflections from newspapers, are analyzed by the data-processing circuit to determine whether the points at which image reflections occur on the array indicate such a profile. The exact way in which this is accomplished will be explained fully in the description below.

Yet another important feature of the invention is that, at regular intervals during its operation (i.e., after a given number of confirmed counts), the threshold just referred to is adjusted to reflect any change which has occurred in the average of heights of the leading edges of the papers on the conveyor. This average is also referred to herein as the "effective" thickness of the papers. During a run of a given size newspaper, the situation can easily develop where papers, as distributed to the offbearing conveyor, become occasionally more closely overlapped, or more spread out. Also, it is well known that different runs of newspapers often comprise papers of different sizes (i.e., thicknesses). Adjustment of the threshold assures predictable count accuracy.

These and other objects and advantages which are attained by the invention will become more fully apparent as the description which now follows is read in conjunction with the accompanying drawings.

DETAILED DESCRIPTION OF THE INVENTION

Figure 1:
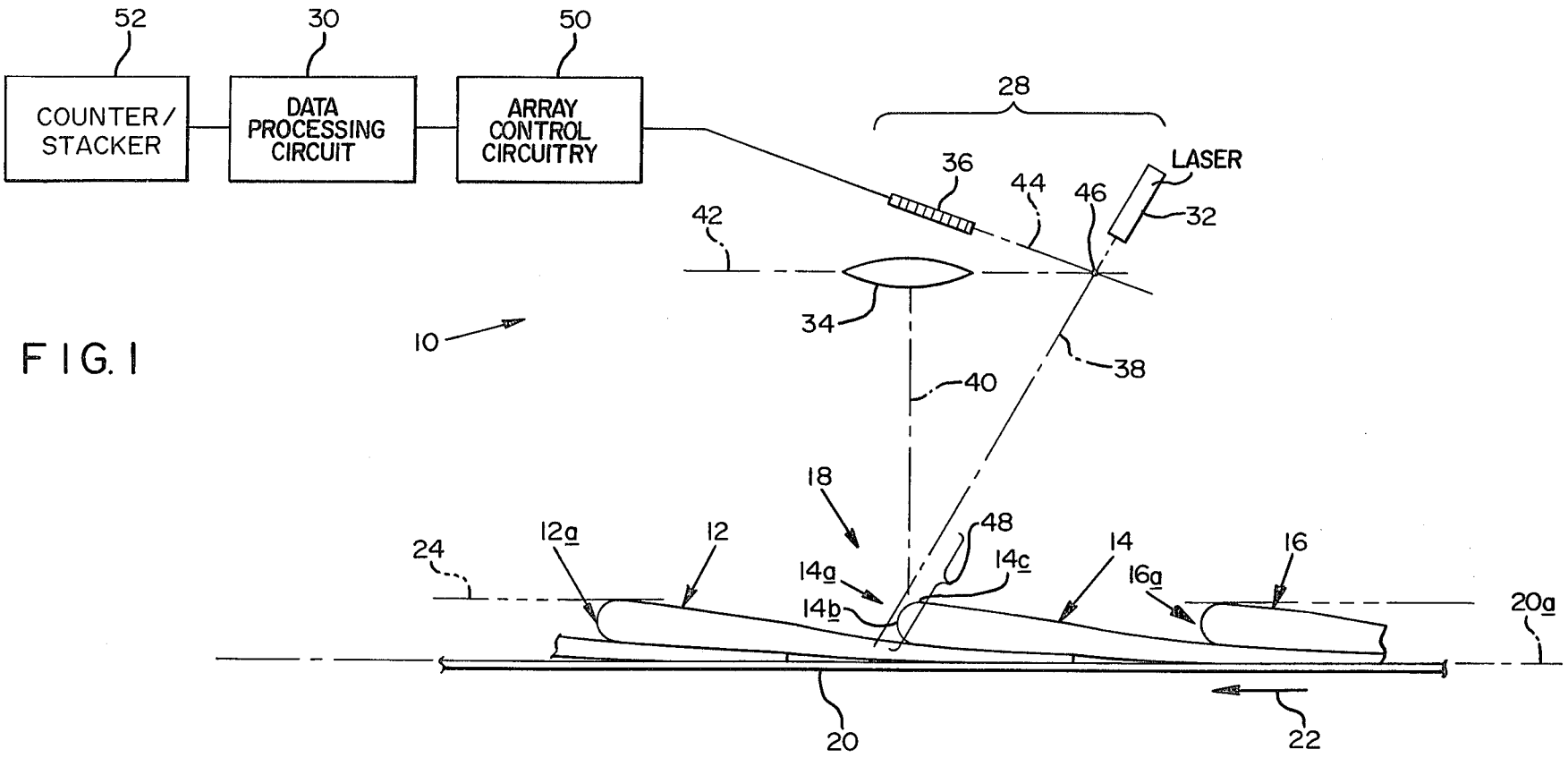
FIG. 1 shows, in fragmentary schematic form, and without regard to exact proportions, apparatus constructed in accordance with the present invention set up to count newspapers which are being transported, overlapped with one another, on a conveyor.

Turning now to the drawings, and referring first to FIG. 1, indicated generally at 10 is counting apparatus constructed in accordance with the present invention. Apparatus 10, as described herein, is set up to count newspapers, such as those shown at 12, 14, 16. These are transported through what is referred to as a counting zone 18 on a conveyor 20 which transports the papers in the direction of arrow 22. Conveyor 20 operates at a travel speed of about 4.5-feet-per-second.

It should be understood that the various proportions and spacings of different elements shown in FIG. 1 have been distorted in order to clarify the manner in which apparatus 10 performs.

The several newspapers which are shown in FIG. 1 are illustrated only fragmentarily, with successive papers overlapping one another, as shown. These papers travel with their folded sides forming what is referred to herein as the leading-edge portions of the papers. Such leading-edge portions for papers 12, 14, 16 are shown at 12*a*, 14*a*, 16*a*, respectively. As can be seen from the paper's profiles, each leading-edge portion includes an expanse, such as expanse 14*b*, which extends generally upwardly at an oblique angle relative to plane 20*a*, which expanse joins with another expanse, such as expanse 14*c*, that extends for a short distance substantially parallel to plane 20*a*. Plane 20*a* is referred to herein also as a defined path.

An important feature of the present invention, which will be more fully explained shortly, is that the articles to be counted, in this case newspapers, are distinguished by the counting apparatus generally in accordance with their leading-edge profiles. Should there be a tear in a paper, with an upwardly projecting flap, or a bulge or wrinkle or the like, such will not be confused by apparatus 10 as being an independent newspaper passing through zone 18, inasmuch as these defects have different profiles.

In the particular condition of the newspapers shown in FIG. 1 on conveyor 20, they are substantially uniformly overlapped, with several inches existing between successive leading edges, and with the uppermost projections of the newspapers (where the two expanses, like expanses 14*b*, 14*c*, merge) lying substantially in a plane, such as plane 24, disposed above and substantially parallel to plane 20*a*. Plane 24 thus marks the effective thicknesses of the papers on the conveyor.

The main elements of apparatus 10 include an electro-optical monitor, or monitoring means, shown generally at 28, and a data-processing circuit, or circuit means, represented by block 30.

The key elements in monitor 28 are shown schematically in FIG. 1, and include a helium-neon laser 32, a lens 34, and a linear photodetector array 36 which is sensitive to helium-neon radiation. Laser 32 directs a small-diameter beam (typically about 1.5-millimeters) downwardly at an oblique angle relative to plane 20*a* along an axis shown by dash-dot line 38. Axis 38 herein is aimed generally downstream relative to the travel direction afforded by conveyor 20, and preferably is disposed at an angle of between about 60° and about 90° relative to plane 20*a*. Axis 38 herein lies at an angle of around 70° relative to plane 20*a*, and extends as shown into zone 18.

Lens 34 is positioned and oriented to view zone 18 generally along a central viewing axis shown by dash-dot line 40. The lens herein is circular (as viewed along axis 40), and is of the multi-element, short focal length variety. Lens 34 lies in a plane shown by dash-dot line 42 which is normal both to the plane of FIG. 1 and to axis 40.

Array 36 is also referred to herein as a reflection receptor, and as a photo-responsive device. The photosensitive face of array 36 is disposed at an angle relative to plane 42, and particular, lies in the plane of FIG. 1 along the dash-dot line shown at 44 which intersects plane 42 at the same point of intersection between this plane and axis 38—such point being shown at 46. This angular orientation for the array assures that images of laser-beam impingement points will, at all points along the length of the array, be in proper focus. For further details respecting the geometric arrangement of laser 32, lens 34 and array 36, reference is made to my U.S. Pat. No. 4,248,532, issued Feb. 3, 1981 for ELECTRO-OPTICAL DISTANCE-MEASURING SYSTEM.

The length of the photo-sensitive face of array 36 is referred to herein as its effective photoresponsive length. Where an image reflection occurs along the length of the array depends upon where along axis 38 an impingement occurs between a newspaper and the beam from laser 32. Thus, the effective photoresponsive length of array 36 defines what is called herein a known range of distances from laser 32 wherein a laser-beam/-newspaper impingement point will be imaged onto the array. This known range of distances is indicated in FIG. 1 by bracket 48.

Completing a description of what is shown generally in FIG. 1, indicated in block form at 50 is array control circuitry which is interposed electrically between array 36 and data-processing circuit 30. Indicated in block form at 52 is a conventional newspaper counter/stacker which is downstream from counting zone 18, and which functions to receive and stack arriving newspapers. Device 52 is connected electrically to the data-processing circuit to receive pulses, as will be described, which effect a newspaper count in the device.

Figure 4:
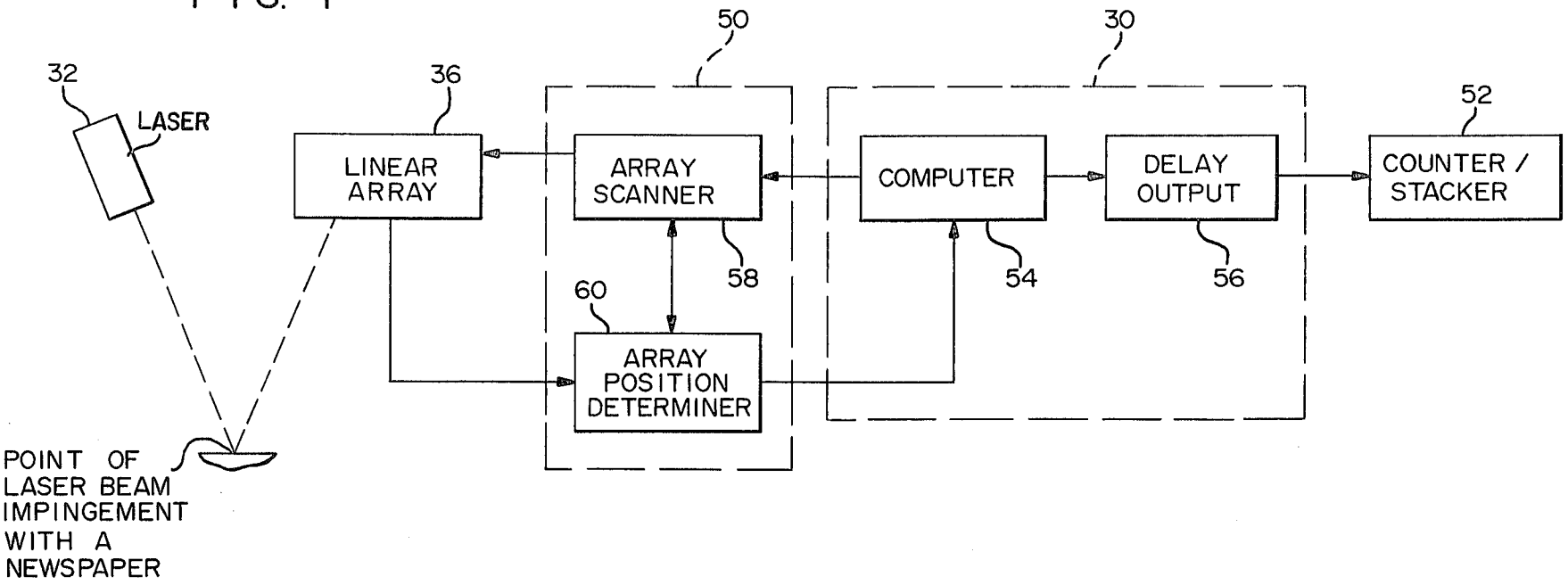
FIG. 4 is a block diagram further illustrating the apparatus of the invention, with interconnections shown between the boxes therein to illustrative cooperative interaction therebetween.

Referring for a moment to FIG. 4, previously mentioned data-processing circuit 30 includes a conventional digital computer or computer means, 54, along with what is referred to as a delay output circuit 56 which is coupled to an output port in computer 54. Circuit 56, like computer 54, is conventional in construction. The output of circuit 56 is coupled to the counting input in counter/stacker 52.

Array control circuitry 50 includes an array scanner 58 and an array position determiner 60. Scanner 58 and position determiner 60 are interconnected as shown. An output port in computer 54 connects with a control input in scanner 58, and an output in the scanner couples with array 36. Position information derived from scanning of the array is fed to an input in position determiner 60, an output in which is connected to an input port in computer 54.

In general terms, clock pulses which are provided by computer 54 cause the array scanner to track, in successive sweeps, along the length of array 36, for the purpose of developing an output signal relating to the level of light incident at different positions along the array. This information is fed to the position determiner, which determines the physical mid-point of a spot of light on the array, to generate a numeric digital output signal whose "numeric level" is directly related to the position along the array where an imaged spot of light is found. The exact details of construction of circuitry 50 form no part of the present invention. However, a full description of the construction and operation of such apparatus will be found in my U.S. Pat. No. 4,221,973, issued Sept. 9, 1980 for LINEAR ARRAY SIGNAL PROCESSING CIRCUITRY FOR LOCATING THE MID-POINT OF A SOURCE OF LIGHT.

Array 36 herein includes 256 photodiodes which are the particular elements whose distribution defines the photoresponsive length of the array. Particular different output numbers are assigned to each of these diodes, beginning at one end of the array with the number "0", and at the opposite end of the array with the number "255". Position determiner 60 produces an output signal, in digital form, which reflects a number included within this range of numbers—which number is directly indicative of the center point of an image of light on the array. Still speaking in general terms, from digital number data supplied by the position determiner to the computer, the latter "knows" where in zone 18 a laser-beam/newspaper impingement has taken place. Thus, the computer is supplied with multiple-scan data capable of providing leading-edge profile information, all for the purpose of confirming the correct counting of successive transported newspapers.

Figure 2:
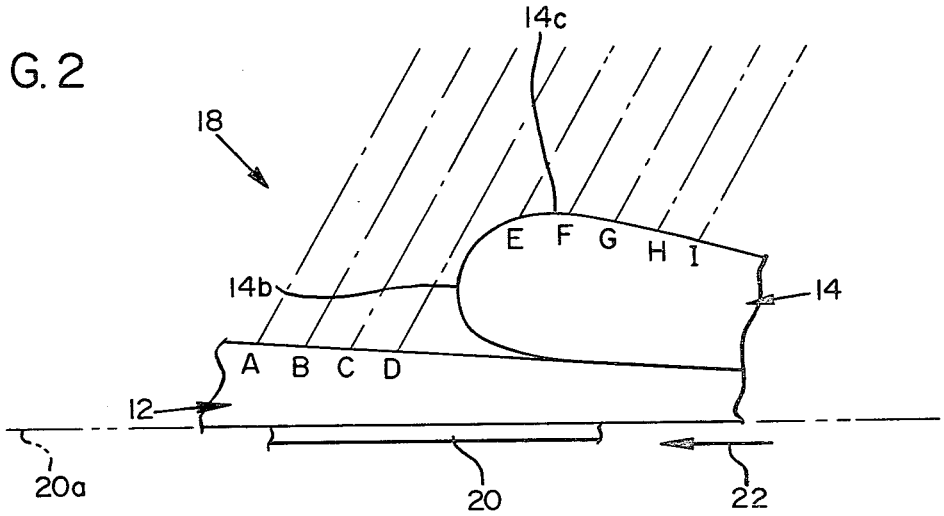
FIG. 2 is a fragmentary schematic detail illustrating a single newspaper counting operation.

FIG. 2 illustrates fragments of newspapers 12, 14. As will be recalled, these newspapers are traveling on conveyor 20 in the direction of arrow 22 at a speed of about 4.5-feet-per-second. It is assumed, for the moment, and it is normally true, that this speed is substantially constant.

Accordingly, as these newspapers travel into and through zone 18, their surfaces are impinged by the beam of laser 32. So long as newspapers exist in zone 18, there exists a continuous condition of laser-beam/newspaper impingement. However, data is acquired from array 36 on a periodic, rather than on a continuous, basis. In other words, scanning of the array takes place under the influence of a clock-pulse generator which operates herein at a frequency of 312-Hertz. This results in the intervals between successive adjacent "scans" being 3.2-milliseconds, and with the "noted" points of impingement between the laser beam and a newspaper being spaced apart by 0.15-inches.

Shown in FIG. 2 are nine slanted dash-dot lines which represent the locations of the laser-beam, during nine successive time-adjacent scans, relative to the portions of newspapers 12, 14 which are shown. One recognizes, of course, that the position of the laser-beam is fixed, and that the newspapers shift positions, but the manner chosen for illustrating the relative positional relationships in FIG. 2 is believed to aid in an understanding of the invention. Thus, the first (in time) of the nine impingements represented in FIG. 2 occurs at point A on newspaper 12. The second, third and fourth impingements occur on newspaper 12 at points B, C, D, respectively. The next impingement point occurs at E on newspaper 14. The sixth, seventh, eighth and ninth impingement points occur, also on newspaper 14, at points F, G, H and I, respectively. It will be noted that the first four impingement points lie relatively low in zone 18. Between impingement points D and E there is a relatively large vertical jump to a location relatively high in zone 18. Impingement points F, G, H and I are substantially at the same elevation in the counting zone, resulting from the fact that surface expanse **14*c* in newspaper 14 substantially parallels plane 20*a***.

As will be more fully explained below, the data derived from the successive impingement points shown in FIG. 2 indicates, properly, the passage in zone 18 of newspaper 14. This will result in a proper and accurate count of this newspaper.

Figure 3:
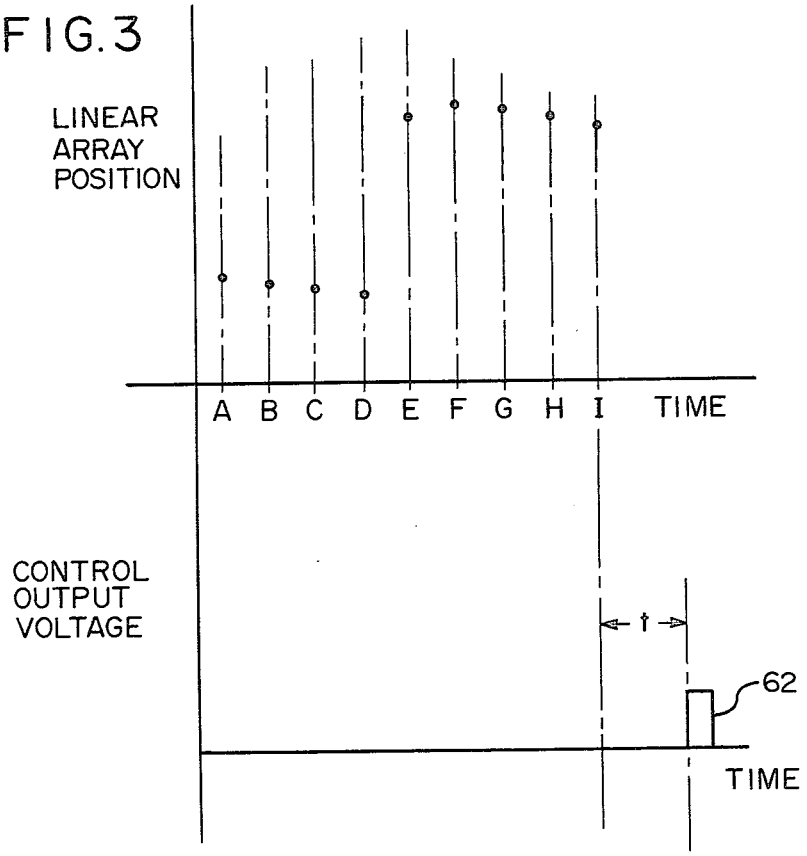
FIG. 3 includes, on a common time base, two graphs—the upper one cooperating with FIG. 2 to illustrate the counting operation mentioned, and the lower one showing, in relation to the upper graph, a control output voltage which is usable to effect a confirmed count.

The upper graph in FIG. 3 contains a plot (over time) of the linear array positions (numbers from 0 through 255) noted as a consequence of the nine impingement points shown in FIG. 2. Considering the way that the array is arranged in apparatus 10, the lower an impingement point is within zone 18, the lower will be the number representing the center point of the reflected image on the array. Accordingly, the plot of nine points in the upper graph of FIG. 2 can be seen to be similar to the arrangement of impingement points found in FIG. 2. In fact, the vertical elevations of the points in the upper graph of FIG. 3 are proportionate to elevations of the impingement points shown in FIG. 2, relative to plane **20*a***.

The lower graph in FIG. 3 relates in time to the upper graph in the figure. As will be explained in what immediately follows, with the arrival of data relating to impingement point I, passage in the zone of newspaper 14, which should be counted, is confirmed. On such confirmation, computer 54 feeds a signal to delay output circuit 56 which, in turn, produces a control output voltage pulse that is fed to the counting input in counter/-stacker 52. Circuit 56 is adjustable to change the amount of delay which it introduces between signaling from the computer and signaling to the counter/stacker, in the range of 0 to about 0.5-seconds. In apparatus 10 a delay of about 0.2-seconds has been set. The purpose for the provision of such a delay is to take into account the physical distance which exists between counting zone 18 and the counter/stacker. This distance will vary from installation to installation, and thus, adjustability in the time delay is a desirable feature. Of course, for a given arrangement of equipment which is known to be fixed once and for all, variability is not required.

What now follows is a description of how the data derived from array 36 is interpreted to determine the passage in zone 18 of a newspaper which is to be counted. As has previously been mentioned, array position determiner 60 outputs a binary digital number which indicates where, along the array, is the center point of an image of light on the array. This data can reflect any number from 0 through 255, so long as there is, in fact, a reflection image on the photoresponsive length of the array. Also as has been mentioned, within range 48 (see FIG. 1), smaller numbers outputed by position determiner 60 indicate impingement points relatively close to plane **20*a*, while larger numbers indicate impingement points farther from this plane. Thus, and since the laser and array occupy fixed positions relative to plane 20*a*, the numbers which are outputed by position determiner 60 are directly interpretable as, and may be thought of as, distance numbers. That is to say, the numbers outputed by position determiner 60** may be treated as having units of distance.

While the data numbers thus fed to computer 54 arrive in units of distance, operations performed in the computer to follow the passage of successive papers end up with a comparison between two numbers, as will be explained, which have units of acceleration. This turns out to be a convenient way to handle the incoming data, and is made possible due to the fact that scanning of array 36 is done at a known fixed rate, and that the transport speed of conveyor 20 is substantially invariant on the time scale of one scan.

In addition to other information which is stored and acted upon by computer 54, the computer is constantly "aware" of the numeric values of the three most current impingement-point data numbers. These will be referred to as $N_1$, $N_2$ and $N_3$, where $N_1$ is the data number most recently received, $N_2$ is the data number next preceeding the most recently received data number, and $N_3$ is the oldest of the three most current data numbers.

What happens in the computer is that a calculation is performed, using the three most current data numbers, to arrive at a number which is then compared to another number known (and previously referred to herein) as a reference threshold number. This number is also referred to as a data threshold.

Explaining more specifically the calculation which is performed, it is expressed as follows:

$$(N_3+N_1-2N_2)$$

The result of this calculation is then compared to the then-current threshold number, which is represented by the letter T. If the calculated number exceeds the current threshold number, then the computer notes the "probability" of a passing paper, and proceeds with another operation to confirm the presence of a new paper, which other operation will be explained shortly.

In order to explain why it is that the calculated number using the three most current data numbers, and the current threshold number, have units of acceleration, let us first examine the derivation for the calculation. The expression $(N_3-N_2)$ computes the difference between the oldest and the next-to-oldest of the three most current data numbers. When one recognizes that a change, if any, in the values of these data numbers takes place in one fixed unit of time, i.e., the time interval between two successive time-adjacent scans of the array, then this calculation can be viewed as having units of velocity, i.e., change in distance per unit of time. The same is true for the calculation expressed as $(N_2-N_1)$, which calculates the difference between the newest and the next newest of the three data numbers. The first of these two calculations can only take place as early in time as the arrival of data number $N_2$. The second of the two calculations can take place only as early in time as receipt of data number $N_1$. By substracting the second of these two velocity calculations from the first, one arrives at the expression first given above herein. And, recognizing that the change, if any, which occurs between these two velocity numbers occurs also in one unit of time, the difference between the two can be thought of as having units of acceleration, i.e., distance per unit of time squared.

Ignoring for a moment how the computer arrives at a value for the current threshold number, and simply assuming that a proper number for the same exists, whenever, as mentioned above, the principal first calculation, using the three most current data numbers, results in a number which exceeds the current threshold number, the computer then functions, in a following operation, to make a confirmation that what in fact has been noted is the leading edge of a new newspaper. In effect, what is done is to see whether for a preselected length, the surface impinged by the laser beam remains no less than a certain distance from plane 20*a*. This is accomplished by examining the actual numeric values of the next four successive data numbers. If these next four data numbers exceed that of the impingement point which immediately preceded the indicated arrival of a newspaper's leading edge, the computer outputs a pulse to delay output circuit 56. Also, it stores the value of the number just most recently calculated from the expression $(N_3+N_1-2N_2)$. The purpose for such storage, as will be explained, is to enable periodic changing or updating of the current threshold number. Returning for a moment to the particular operation which is being described, in apparatus 10, application of a pulse from computer 54 to delay output circuit 56 results in circuit 56 supplying the counter/stacker with a counting pulse 0.2-seconds thereafter. In the counter/stacker, as successive bundles of newspapers are being prepared, the counter/stacker knows, through equipment which is in no way related to the present invention, how many papers are to be contained in each successive bundle. The count signals received by it from circuit 56 are used to assemble the bundles, each with the proper number of newspapers, and also to maintain a running overall count of the number of newspapers which have been printed. The latter information is used, at the appropriate moment, to shut down the entire printing operation.

In apparatus 10, every sixteen validated newspaper counts define a time interval for periodic rechecking, and if necessary resetting, of the current threshold number. This is done by averaging the last sixteen stored values of the calculation $(N_3+N_1-2N_2)$, and by multiplying this average by the fraction 5/16. The latter calculation, whatever it turns out to be, immediately becomes the succeeding current threshold number. At the beginning of a counting operation, and before it has been possible to compute a current threshold number on the basis of counted newspapers, an arbitrary current threshold number is set in apparatus 10 to the value of ten. This value, of course, is considered to have units of acceleration.

Returning now to FIGS. 2 and 3, let us consider some actual data numbers and calculations with respect to the nine impingement points shown in FIG. 2. Presented in the table immediately following are the numbers related to these points, which numbers are fed to computer 54:

| IMPINGEMENT POINT | NUMBER |
|---|---|
| A | 40 |
| B | 38 |
| C | 37 |
| D | 35 |
| E | 110 |
| F | 112 |
| G | 111 |
| H | 110 |
| I | 108 |

Also, let us assume, for the moment, that the current threshold number, T, is equal to 21. The calculation for impingement points A,B,C is as follows, recalling that the number for C is equivalent to $N_1$, that for B is equivalent to $N_2$, and that for A is equivalent to $N_3$:

CALCULATION (A,B,C)

$$(40+37-2\times38)=(77-76)=(1)$$

The computed number is 1, and this, of course, is less than the current threshold number 21, and accordingly is ignored.

The calculation relating to impingement points B,C,D is as follows:

CALCULATION (B,C,D)

$$(38+35-2\times37)=(73-74)=(-1)$$

Here also the calculated number is less than the current threshold number, and thus also is ignored.

The calculation for impingement points C,D,E, however, produces a quite different result, as follows:

CALCULATION (C,D,E)

$$(37+110-2\times35)=147-70=(77)$$

Here, the calculated number 77 definitely exceeds the current threshold number, and informs the computer to enter into a confirming operation.

What then occurs is that the computer examines the next four successive data numbers, relating to impingement points F, G, H, and I, to determine whether their values exceed the number 35—the data-point number immediately preceding the number (110) indicating the leading edge of newspaper 14. From the table, it will be seen that these numbers do in fact exceed the number 35, and on receipt of data resulting from impingement point I, the computer confirms the presence of a new newspaper to be counted. Accordingly, it supplies a pulse to delay output circuit 56, which, after a delay interval of 0.2-seconds, shown at "t" in FIG. 3, produces a counting output pulse, shown at 62 in FIG. 3, to the counter/stacker.

On confirmation that there is a paper to be counted, the most recently calculated value which triggered the confirming operation, 77, is stored by the computer.

This same operation continues and repeats for each successive newspaper. Let us assume that the computed value 77 generated by noting of newspaper 14 is the first in a group of sixteen to be used for adjusting, if necessary, the current threshold number. Let us assume further that after the next fifteen newspapers are counted, the average of the stored numbers, corresponding to the number 77, is 80. This average is multiplied by the fraction 5/16 to produce the number 25, which immediately becomes the reference threshold number. This checking and adjusting of the current threshold number takes place recurrently every sixteen newspaper counts.

It should now thus be apparent how the apparatus of the present invention performs conveniently and accurately to count passing articles, such as newspapers. Counting is accomplished in a noncontacting way which in no way disrupts the flow of counted articles, and in a way assuring counting accuracy through "keying in" on the leading-edge profiles of monitored articles. Should these profiles change, for example by newspapers being distributed differently on a conveyor, or as a consequence of a change in the overall folded size of the newspapers, the apparatus automatically takes this into account through the process of resetting periodically what has been referred to herein as a current reference threshold number. The apparatus of the invention, in experimental tests thereof, has been established to have an accuracy at least to one count in ten thousand.

The apparatus is easily installed, not only for use in counting newspapers, but also in a number of other applications, without requiring any appreciable modification of the equipment in conjunction with which it is used.

While a preferred embodiment of the invention has been shown and described herein, it is appreciated that variations and modifications may be made without departing from the spirit of the invention.

It is claimed and desired to secure by Letters Patent:

1. Apparatus for enabling the exclusive discriminatory counting, in a counting zone, of successive known-shape articles, as distinguished from other objects with other shapes, which articles are transported through the zone along a defined path, where such articles are characterized each by a leading-edge portion having a first surface expanse which extends at an oblique angle relative to said path, which first surface expanse joins with a second surface expanse that extends for at least a preselected length no less than a certain distance from said path, and where the stream of articles is characterized by an effective thickness in the zone, said apparatus comprising electro-optical monitoring means constructed and disposed to monitor, in said counting zone, successive passing objects, said monitoring means being operable to produce a train of successive data signals each indicative of a related position, vis-a-vis the position of said path, of a surface-expanse area on a passing object, and data-processing circuit means operatively connected to said monitoring means to receive said data signals therefrom, operable, on receiving each such signal, to determine, first, and in light of previously received data signals, whether the signal indicates the presence in the zone of an object surface expanse which extends at an oblique angle relative to said path, and if so, to determine, thereafter, from succeeding data signals, whether they collectively indicate the presence of an object surface expanse which extends no less than said certain distance from said path over said preselected length.

2. The apparatus of claim 1, wherein said data-processing circuit means includes computer means constructed to generate a defined data threshold, by comparison with which the presence of an object surface expanse extending at an oblique angle relative to said path is detected, with said computer means further being constructed periodically, and in accordance with a predetermined number of articles counted, to adjust the value of said data threshold in accordance with, and in proportion to, any change which has occurred, since the last such adjustment, in the average effective thickness of articles passing through said counting zone, as determined from data signals received by said data-processing circuit means.

3. Apparatus for enabling the exclusive discriminatory counting, in a counting zone, of successive known-shape articles, as distinguished from other objects with other shapes, which articles are transported through the zone along a defined path, where such articles are characterized each by a leading-edge portion having a first surface expanse which extends at an oblique angle relative to said path, which first surface expanse joins with a second surface expanse that extends for at least a preselected length no less than a certain distance from said path, and where the stream of articles is characterized by an effective thickness in the zone, said apparatus comprising a laser positioned to direct a beam of radiation toward said zone to impinge objects passing therethrough, a reflection receptor for receiving laser radiation reflected from an object impinged in the zone, said receptor including an elongated photoresponsive device in the form of a linear photodetector array, or the like, said array having an effective photoresponsive length, and being oriented relative to said laser in such a manner that laser-beam/object impingements which occur at different points within a known range of distances from said laser, and within said zone, are reflected to produce images located at different proportionately related locations along said effective photoresponsive length, said known range of distances being located in a known manner relative to said path, means operatively connected to said array for scanning the same recurrently to detect the presence of any reflected image thereon, and for producing, from each such detected image, a data signal directly indicative of the image's position along said effective length, and data-processing circuit means operatively connected to said scanning means to receive said data signals therefrom, operable, on receiving each such signal, and in light of previously received data signals, to determine, first, whether the signal indicates the presence in the zone of an object surface expanse which extends at an oblique angle relative to said path, and if so, to determine, thereafter, from succeeding data signals, whether they collectively indicate the presence of an object surface expanse which extends no less than said certain distance from said path over said preselected length.

4. The apparatus of claim 3, wherein said data-processing circuit means includes computer means constructed to generate a defined data threshold, by comparison with which the presence of an object surface expanse extending at an oblique angle relative to said path is detected, with said computer means further being constructed periodically, and in accordance with a predetermined number of articles counted, to adjust the value of said data threshold in accordance with, and in proportion to, any change which has occurred, since the last such adjustment, in the average effective thickness of articles passing through said counting zone, as determined from data signals received by said data-processing circuit means.

* * * * *